US006596359B2

(12) United States Patent
Roth et al.

(10) Patent No.: US 6,596,359 B2
(45) Date of Patent: Jul. 22, 2003

(54) DUPLEX LABEL LAMINATE

(75) Inventors: Joseph D. Roth, Springboro, OH (US); Wayne D. Finster, Viroqua, WI (US)

(73) Assignee: NCR Corporation, Dayton, OH (US)

( * ) Notice: Subject to any disclaimer, the term of this patent is extended or adjusted under 35 U.S.C. 154(b) by 73 days.

(21) Appl. No.: 09/775,998

(22) Filed: Feb. 2, 2001

(65) Prior Publication Data

US 2002/0106494 A1 Aug. 8, 2002

(51) Int. Cl.[7] ..... G09F 3/00

(52) U.S. Cl. ..... 428/40.1; 428/195; 428/198; 428/201; 428/40.1; 428/42.1; 428/42.2; 428/42.3; 283/81; 156/250; 156/269; 156/277; 156/280; 156/289; 156/291; 427/208.6

(58) Field of Search ..... 428/195, 198, 428/201, 40.1, 42.1, 42.2, 42.3; 283/81; 156/250, 269, 277, 280, 289, 291; 427/208.6

(56) References Cited

U.S. PATENT DOCUMENTS 5,336,541 A * 8/1994 Kobayashi ..... 428/40
5,580,640 A * 12/1996 Kraft et al. ..... 428/195
6,268,032 B1 * 7/2001 Mertens et al. ..... 428/401

OTHER PUBLICATIONS

*Scan Tech News Online*, "Linerless label printing: New technology with proven savings," Nov. 1996, two pages.

* cited by examiner

*Primary Examiner*—Deborah Jones
*Assistant Examiner*—Ling Xu
(74) *Attorney, Agent, or Firm*—Francis L. Conte

(57) ABSTRACT

A laminate includes duplex labels laminated together by patches of adhesive alternating oppositely therebetween. The labels may be removed from each other, with each label having adhesive on the back side thereof.

20 Claims, 10 Drawing Sheets

DUPLEX LABEL LAMINATE

BACKGROUND OF THE INVENTION

The present invention relates generally to labels, and, more specifically, to pressure sensitive labels.

A typical pressure sensitive label includes a face sheet which defines the label itself, and has a front side which may be readily printed. The back side of the label includes pressure sensitive adhesive permanently bonded thereto for use in adhering the label to any desired surface.

To initially protect the adhesive on the back of the label, a thinner release liner is laminated there against. A typical release liner is coated with a release agent, such as silicone, which creates a non-permanent or temporary bond with the label adhesive for permitting removal of the label from the liner, with the adhesive remaining attached to the label while being freely released from the liner.

During use, the label laminate may be printed upon by being passed through a conventional printer, for example. The printed label is then simply peeled away from the liner and applied to the desired surface. The liner is then discarded as waste having done its job of protecting the label adhesive prior to the intended use thereof.

A typical liner is in the form of super calendered kraft paper which is thinner than label face sheet stock and is weaker due to damage to the paper fibers therein. Pores in the liner are substantially eliminated for reducing the amount of silicone needed to treat its surface, and the liner is exceptionally smooth and translucent, and not readily printable. The liner is, accordingly, specially manufactured and typically accounts for almost half the cost of producing the label laminate. And, the liner must be discarded at additional cost.

Accordingly, it is desired to provide an improved label which reduces or eliminates the need for the disposable release liner.

BRIEF SUMMARY OF THE INVENTION

A laminate includes duplex labels laminated together by patches of adhesive alternating oppositely therebetween. The labels may be removed from each other, with each label having adhesive on the back side thereof.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
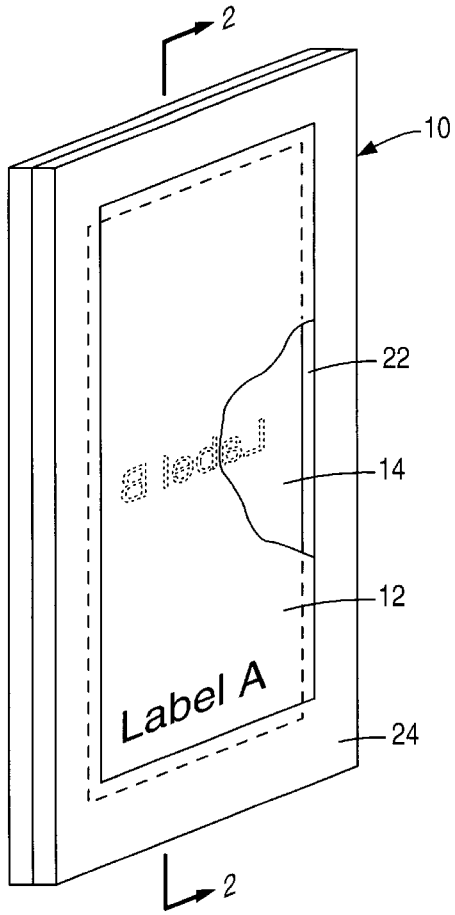
FIG. 1 is an isometric view of a duplex label laminate in accordance with an exemplary embodiment of the present invention.
Figure 2:
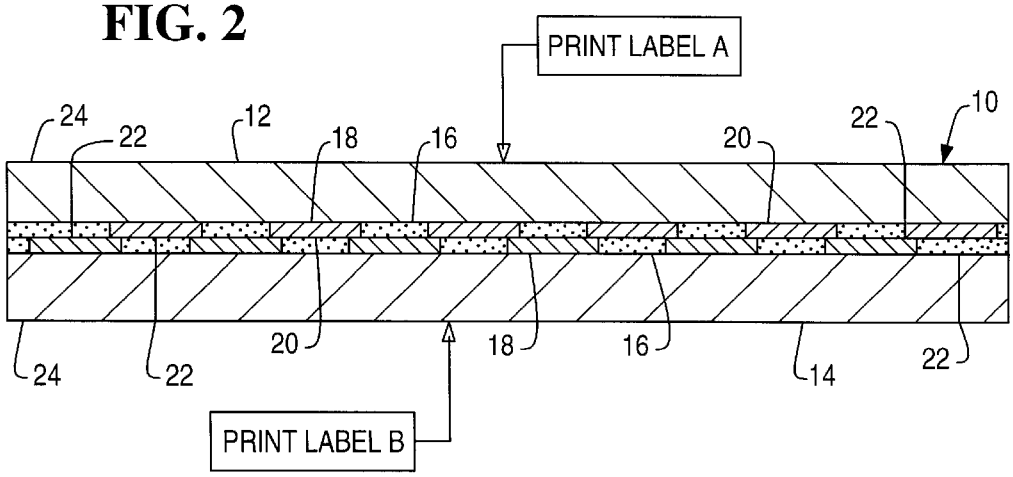
FIG. 2 is a cross sectional view of the laminate illustrated in FIG. 1 and taken along line 2—2.

Illustrated in FIGS. 1 and 2 is a duplex label laminate 10 in accordance with an exemplary embodiment of the present invention. The laminate includes first and second adhesive labels 12,14 laminated together back-to-back by discrete patches of adhesive 16 alternating oppositely therebetween.

As shown in FIG. 2, the adhesive patches 16 are alternately fixedly and removably bonded to the back sides of the opposing two labels 12,14. The adhesive 16 may have any conventional form, and is preferably a pressure-sensitive adhesive commonly used in manufacturing pressure-sensitive adhesive labels. The adhesive is permanently bonded to the back sides of the two labels by being initially coated or applied thereto during manufacture. The exposed surface of the adhesive then has a suitably low adhesion characteristic for providing a removable bond with the back surface of the opposite label.

In this way, each label itself effectively provides a release liner for the opposite label to which it is removably attached, and thusly completely eliminates the need for the conventional silicone release liner which would otherwise be discarded as waste. Whereas the silicone release liner cannot be printed for use and contains no adhesive bonded thereto, the two labels 12,14 each include adhesive, and each may be readily printed over its front or face side.

Since the two labels illustrated in FIG. 2 are bonded to each other preferably without any intervening, discrete release liner therebetween, the two labels have complementary patterns of the adhesive patches 16 fixedly bonded thereto which cooperate with opposite release zones or blanks 18 devoid of the adhesive. In this way, an adhesive patch 16 permanently bonded to the back surface of one label is aligned in register with a corresponding blank 18 devoid of adhesive on the opposite label. The blanks 18 are arranged in a pattern or matrix to complement the adhesive pattern on the opposite label for permitting release of the adhesive on the opposite label where it is temporarily bonded to the opposite blank.

In the preferred embodiment illustrated in FIG. 2, the label blanks 18 preferably include a release 20 in the preferred form of a silicone release coating or agent disposed on the back side of the labels for forming a removable bond with the corresponding adhesive patches.

In this way, the adhesive patches on the back side of one label are temporarily bonded to the release blanks on the back side of the opposite label for permitting the duplex labels to be readily peeled apart from each other with the adhesive remaining on the original label to which it was applied during manufacture. Since both labels may be formed of any suitable label material, the exposed front surfaces of each label may be suitably printed upon as illustrated schematically in FIG. 2 using any type of equipment such as various printers, or by hand printing.

In the preferred embodiment illustrated in FIGS. 1 and 2, each of the labels 12,14 includes a rectangular perimeter 22 which is preferably die-cut in any conventional manner. The adhesive patches 16 and release blanks 20 preferably alternate laterally across the label along respective portions of the perimeter.

The alternating patterns of adhesive and release illustrated in FIG. 2 may be effected in various embodiments, preferably with the configuration or field of the release 20 being slightly larger than that of the corresponding adhesive patches to prevent permanent bonding of the two labels together within the boundary of the individual labels themselves. For example, FIG. 3 illustrates the complementary adhesive patterns on the back sides of the two labels 12,14 in the form of alternating stripes of adhesive 16*s*, which correspond with alternating stripes 20*s* of the release inside the label perimeter 22.

Figure 4:
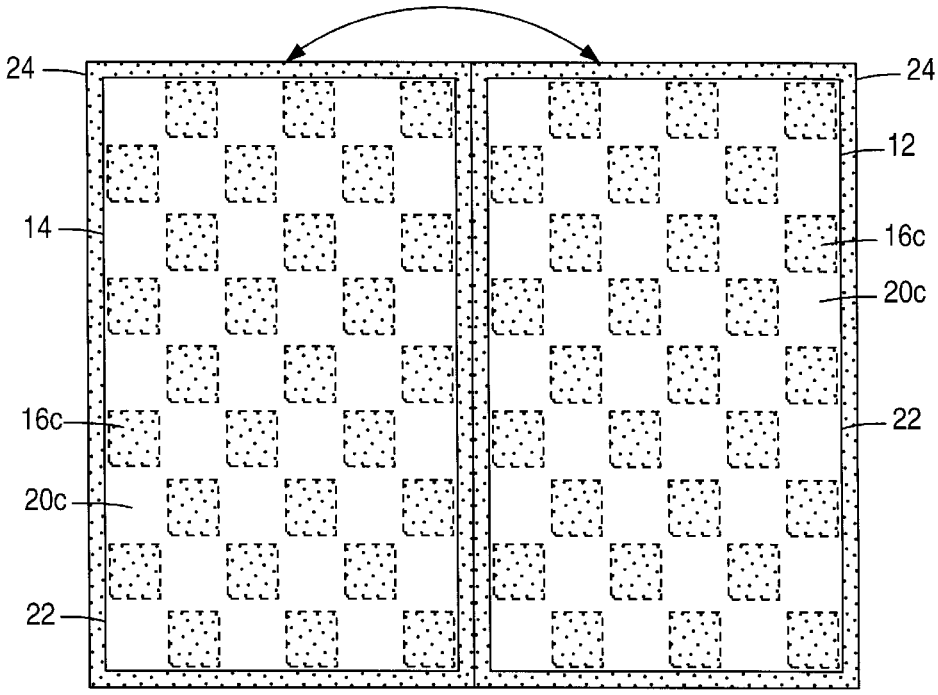
FIG. 4 is a plan view of the duplex labels of FIG. 1 being separated from each other and having an adhesive pattern in accordance with another embodiment of the present invention.

FIG. 4 illustrates yet another embodiment where the complementary adhesive patterns of the two labels 12,14 include alternating checkerboards of the adhesive 16*c* which cooperate with corresponding checkerboards 20*c* of the release inside the label perimeter 22.

Figure 3:
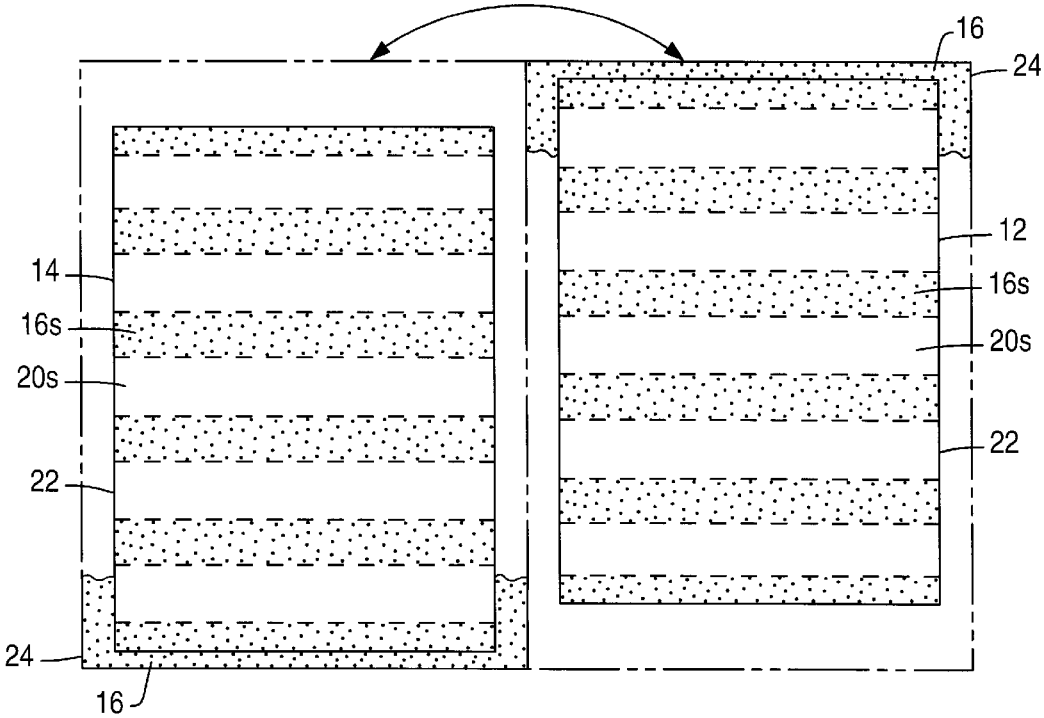
FIG. 3 is a plan view of the duplex labels illustrated in FIG. 1 being separated from each other and having an adhesive pattern in accordance with an exemplary embodiment of the present invention.

In both embodiments illustrated in FIGS. 3 and 4, each label 12,14 includes a plurality of the adhesive patches on the back side thereof with corresponding intervening blanks of the release agent for providing multiple locations of the adhesive on the back sides of the labels which may then be used for bonding each label to its intended surface upon being removed from the opposite label.

In the stripe pattern illustrated in FIG. 3, it is preferred to have adhesive stripes extending along the full length of two opposite edges of the label to ensure secure bonding with the intended surface. The remaining two edges of each label may have alternating patches of adhesive which also ensure a secure, although spatially interrupted, bond to the intended surface.

In the checkerboard pattern illustrated in FIG. 4, the adhesive patches alternate around the entire boundary of each label for ensuring an effective bond to the intended surface.

The labels 12,14 illustrated in FIG. 1 are preferably formed from corresponding face sheets of any suitable material, such as paper, preferably having the same thickness. In the exemplary embodiment illustrated in this Figure, each face sheet includes a single label 12,14, and each label is surrounded by a corresponding perimeter rim 24 of the face sheet permanently or fixedly bonded together for ensuring the overall integrity of the duplex label laminate.

In the preferred embodiment illustrated in FIG. 2, the opposite rims of the two labels are preferably fixedly or permanently bonded together by respective portions of the adhesive 16 bridging the two face sheets. This is illustrated in more detail in FIG. 3 wherein the entire perimeter rim 24 of each label may be fully coated by the adhesive 16 on the back side thereof which will form a permanent bond with the corresponding adhesive on the opposite label rim when the two face sheets are laminated together.

In the embodiment illustrated in FIGS. 1–3 each face sheet includes a single label therein. The two labels are substantially equal in size and aligned together in the laminate, but offset vertically from each other across the width of the stripes or span length of the label illustrated in FIG. 2 to ensure that the die-cut perimeter 22 is located in corresponding portions of the adhesive stripes for each of the two labels.

Figure 5:
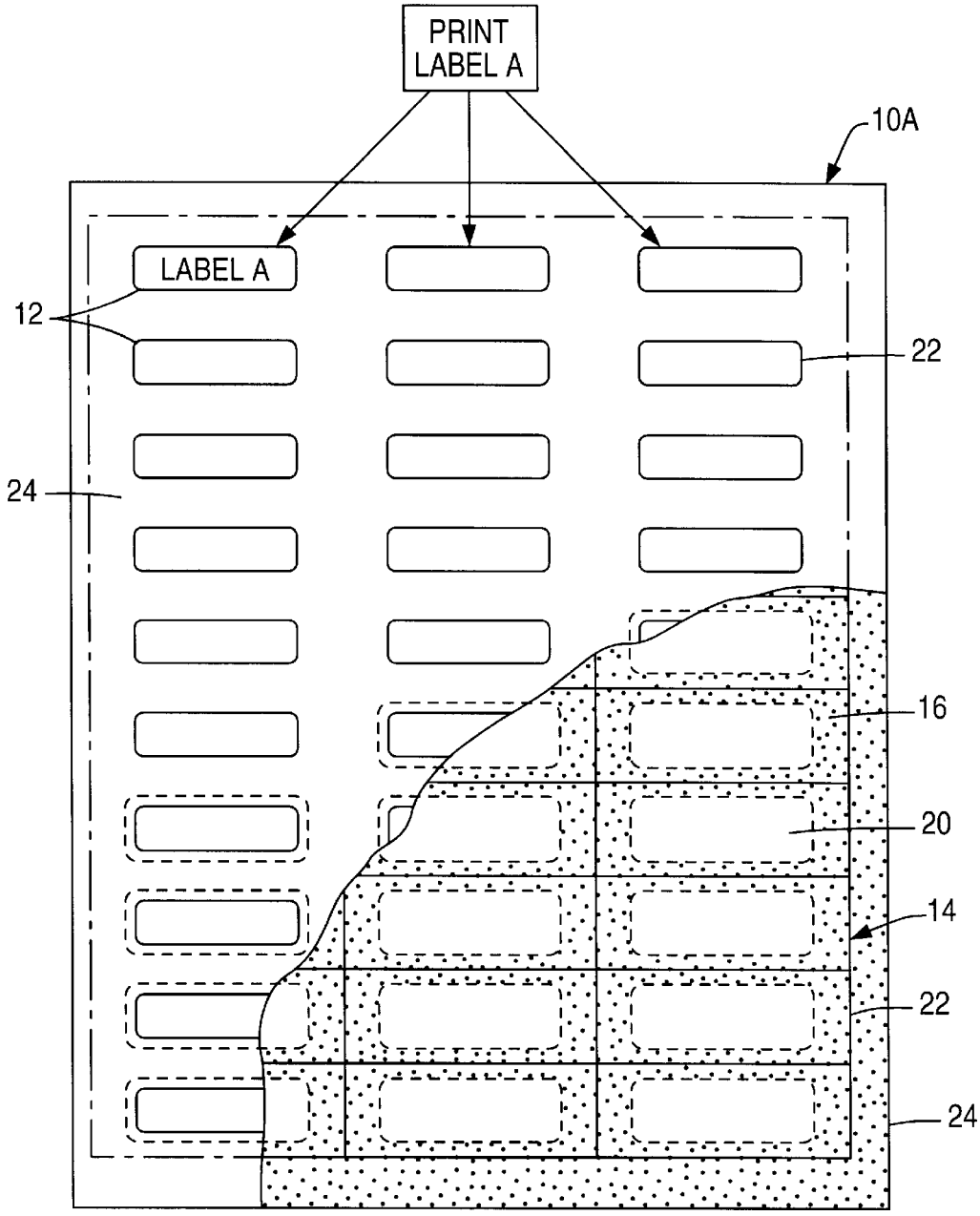
FIG. 5 is a partly sectional view of a first side of a duplex label laminate having an array of small labels in accordance with an exemplary embodiment of the present invention.
Figure 6:
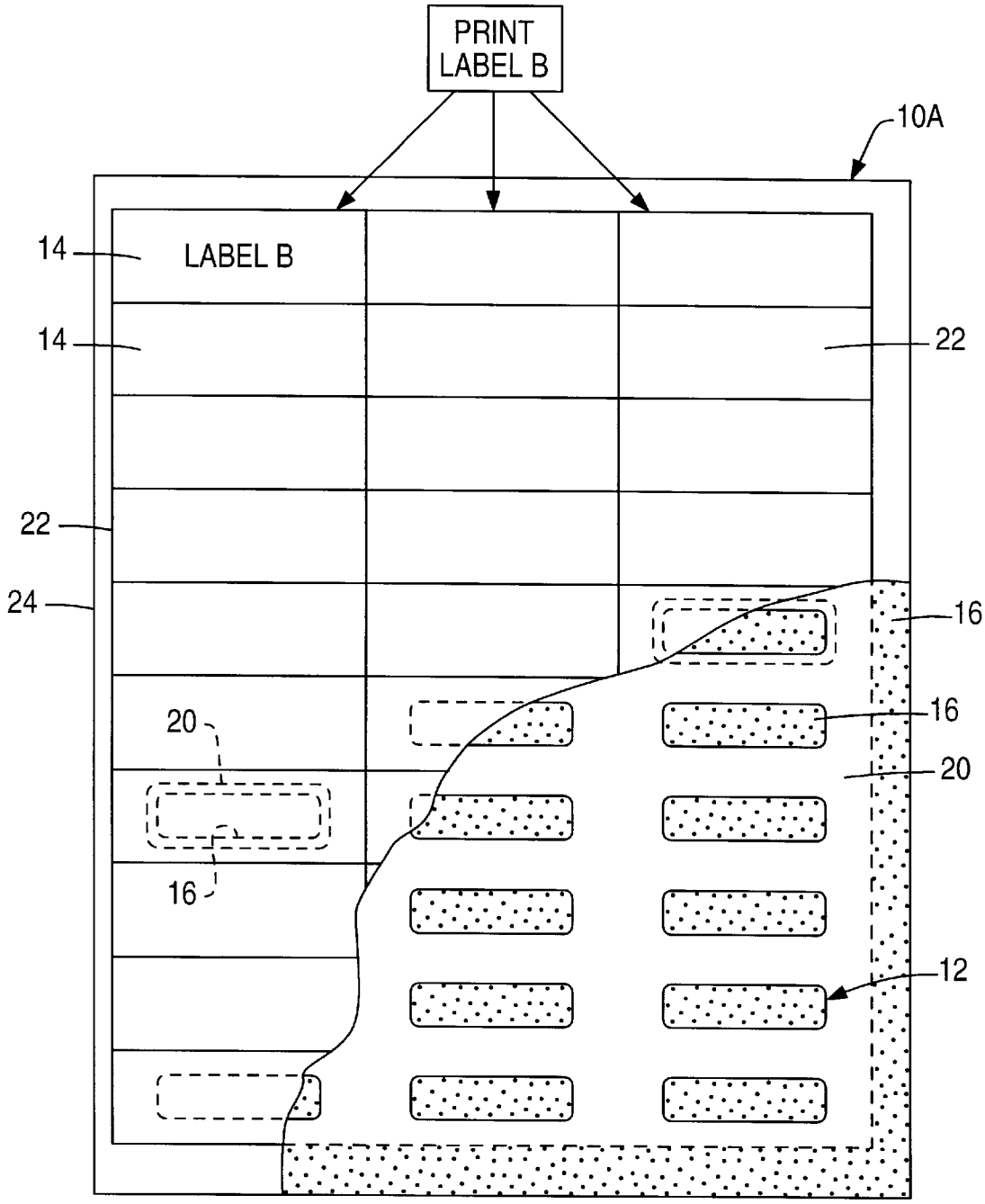
FIG. 6 is a partly sectional view of the opposite side of the duplex label laminate illustrated in FIG. 5 having an array of large labels registered with corresponding ones of the small labels on the opposite side.

FIGS. 5 and 6 illustrate a duplex label laminate designated 10A in accordance with an alternate embodiment of the present invention wherein each of the face sheets includes a respective plurality of the first and second labels 12,14. Each of the labels 12,14 includes a respective generally rectangular die-cut perimeter 22 for defining the individual labels in the corresponding face sheets. In the exemplary embodiment illustrated, there are three columns of ten labels 12,14 on each of the face sheets defining thirty useable labels on each of the opposite sides of the laminate.

In this embodiment, the corresponding first labels 12 on one side of the laminate are nested with corresponding ones of the second labels 14 on the opposite side of the laminate using complementary adhesive patterns correspondingly nested. In the nested embodiment illustrated in these Figures each of the first labels 12 is preferably smaller than the corresponding larger opposite label 14 in which it is nested, and sized to fit within a central release blank 20 thereof. The adhesive patch 16 for each of the first labels 12 preferably completely covers the back side thereof within its full perimeter.

Correspondingly, the adhesive patch 16 for each of the second labels 14 illustrated in FIG. 5 follows the perimeter thereof to define an adhesive strip or border therearound, with the release blank 20 being disposed centrally inside the back side of the second label opposite to the adhesive patch of the first label.

In this way, the large labels 14 illustrated in FIG. 6 may have maximum coverage within the narrow common rim 24 extending around the face sheet, with the individual second labels 14 directly adjoining each other at common die-cut perimeters 22.

The first labels 12 illustrated in FIG. 5 are correspondingly smaller in size than the second labels 14, and the die-cut perimeters 22 of the individual small labels 12 are correspondingly spaced apart from each other for creating a matrix rim 24 surrounding each and all of the small labels. The narrow perimeter 24 of the large label face sheet is permanently bonded to the corresponding four edges of the small label face sheet by the adhesive disposed therebetween without intervening release agent.

In this way, the individual small or large labels 12,14 may be separately removed from the duplex label laminate and adhesively applied to any intended surface. The small labels 12 are fully covered by adhesive on their back sides in the manner of a typical pressure-sensitive label. The large labels 14, however, include only a perimeter border of adhesive on their backsides, with the central portion thereof including the release agent against which the corresponding small labels are temporarily bonded in the laminate. Nevertheless, the border adhesive patch for the large labels is sufficient for forming a permanent bond to secure each large label to an intended surface.

In the initial construction of the laminate illustrated in FIGS. 5 and 6, the perimeter bonding of the face sheets together creates a duplex label laminate which is stronger and stiffer than a single-sheet face sheet with conventional thinner, silicone liner. The stronger laminate will enjoy improved feeding through conventional printers, like laser printers, with less susceptibility of predispensing of individual labels while being carried through the printer.

As shown in FIGS. 5 and 6, both sides of the laminate may be correspondingly printed for each of the several labels found thereon. Each of those labels may be separately removed from either side of the laminate and used in any conventional manner. The remaining portions of the two face sheets maintain integrity of the laminate as the individual labels are removed therefrom. Upon complete removal of all the labels from both face sheets, the rim 24 of the first face sheet and the thirty small apertures therein remain along with the narrow rim 24 of the opposite second face sheet, and reduces the overall waste of the duplex laminate.

A particular advantage of the duplex label laminate construction is the ability to specifically tailor each of the two label laminates for a specific application different than the other label laminate, if desired. The size of the opposite duplex labels may be identical or different, and the adhesive used on the back sides thereof may be the same or different.

Figure 7:
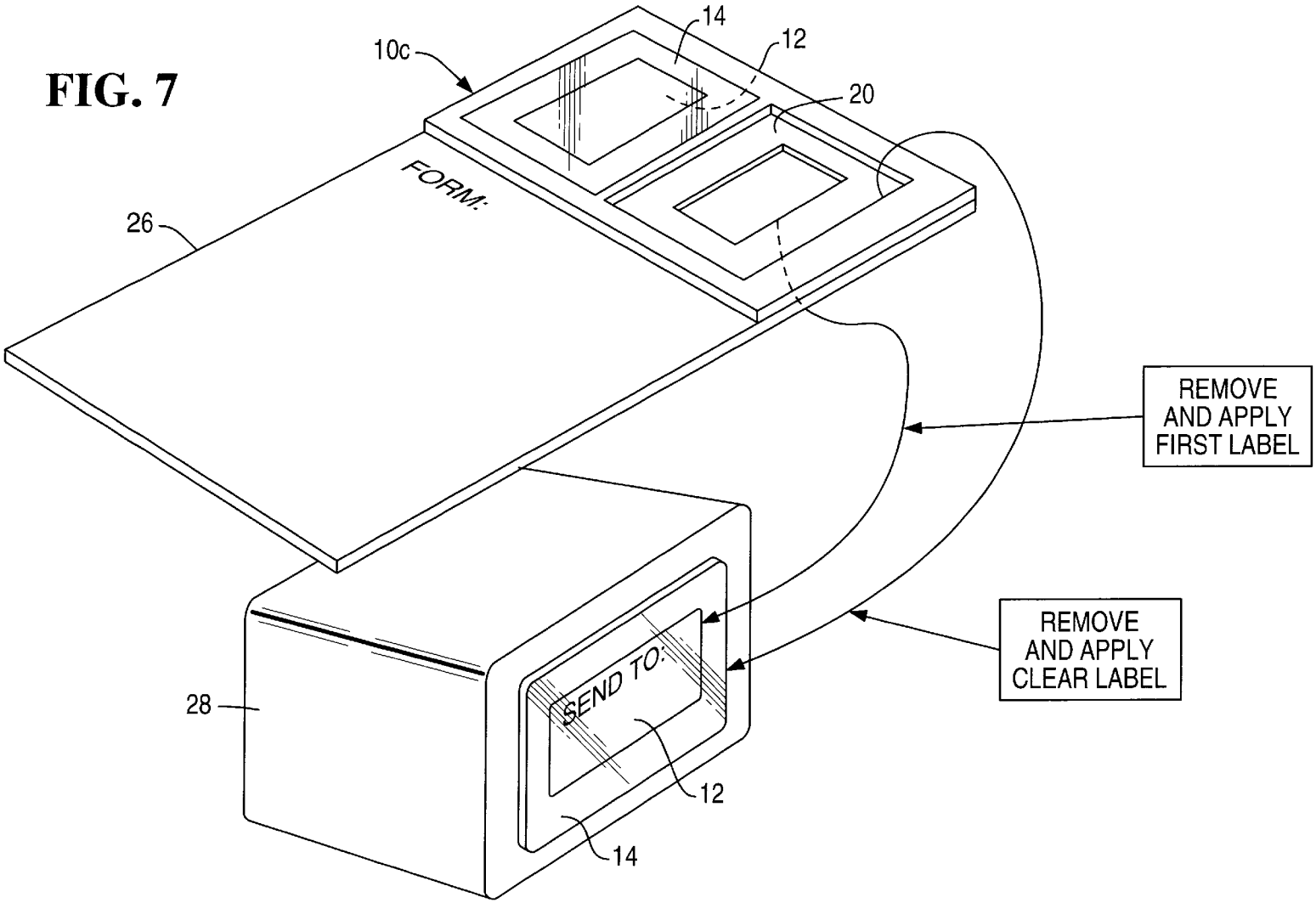
FIG. 7 is an isometric view of a duplex label laminate and cooperating form sheet in accordance with another embodiment of the present invention for use in labeling a shipping container or mailer.

For example, FIG. 7 illustrates another form of the duplex label laminate designated 10C which includes two pairs of the duplex labels 12,14 formed at one end of a common, integrated form sheet 26. A common face sheet may be used for forming both the form sheet 26 and the first labels 12 die-cut therein. And, a smaller, separate face sheet may be laminated to the back side of one end of the form sheet to form the second labels 14 in the same manner described above.

For example, the duplex labels 12,14 have the nested configuration illustrated in the embodiment of FIGS. 5 and 6. The first labels 12 are preferably opaque like typical label paper and may be suitably printed for use as shipping labels, for example. Correspondingly, the second labels 14 may be partially or fully transparent and may be formed of a suitable material like clear polyester.

Accordingly, a method of using the laminate 10C illustrated in FIG. 7 includes printing any suitable indicia or printing on the front side of the first label 12 using any suitable printer or manual printing for example. The printed first label may then be removed from the second laminate, with the first label including adhesive on its entire back side which is initially registered atop the release blank centrally located on the back side of the second label 14.

The so removed first label 12 may then be bonded atop a corresponding surface of a delivery package or mailer 28 using the same adhesive provided on the back of the first label.

The second label 14 may then be removed from the remaining portion of the face sheet of the laminate and applied over the first label previously applied to the mailer 28. As indicated above, the perimeter border of the back side of the second label 14 includes the adhesive thereon which is used to attach the second label to the mailer, with the first label being disposed centrally therein. Since the second label 14 is transparent, the printing atop the first label 12 is visible therethrough. In this way, the clear second label 14 may be used to protect the printed first label attached to the shipping mailer.

Figure 8:
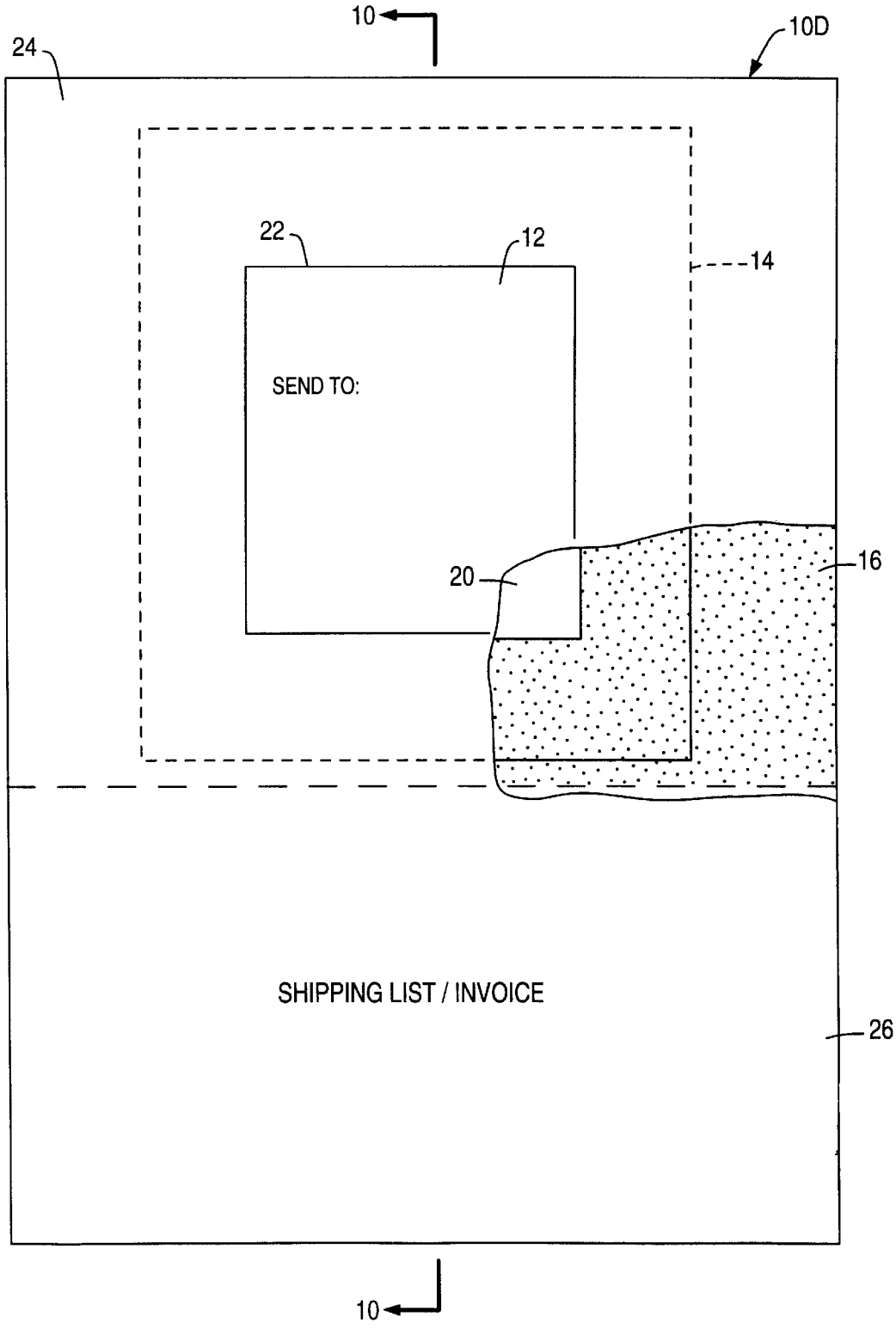
FIG. 8 is a front view of a duplex label laminate in accordance with another embodiment in the form of a shipping label and integrated form.
Figure 9:
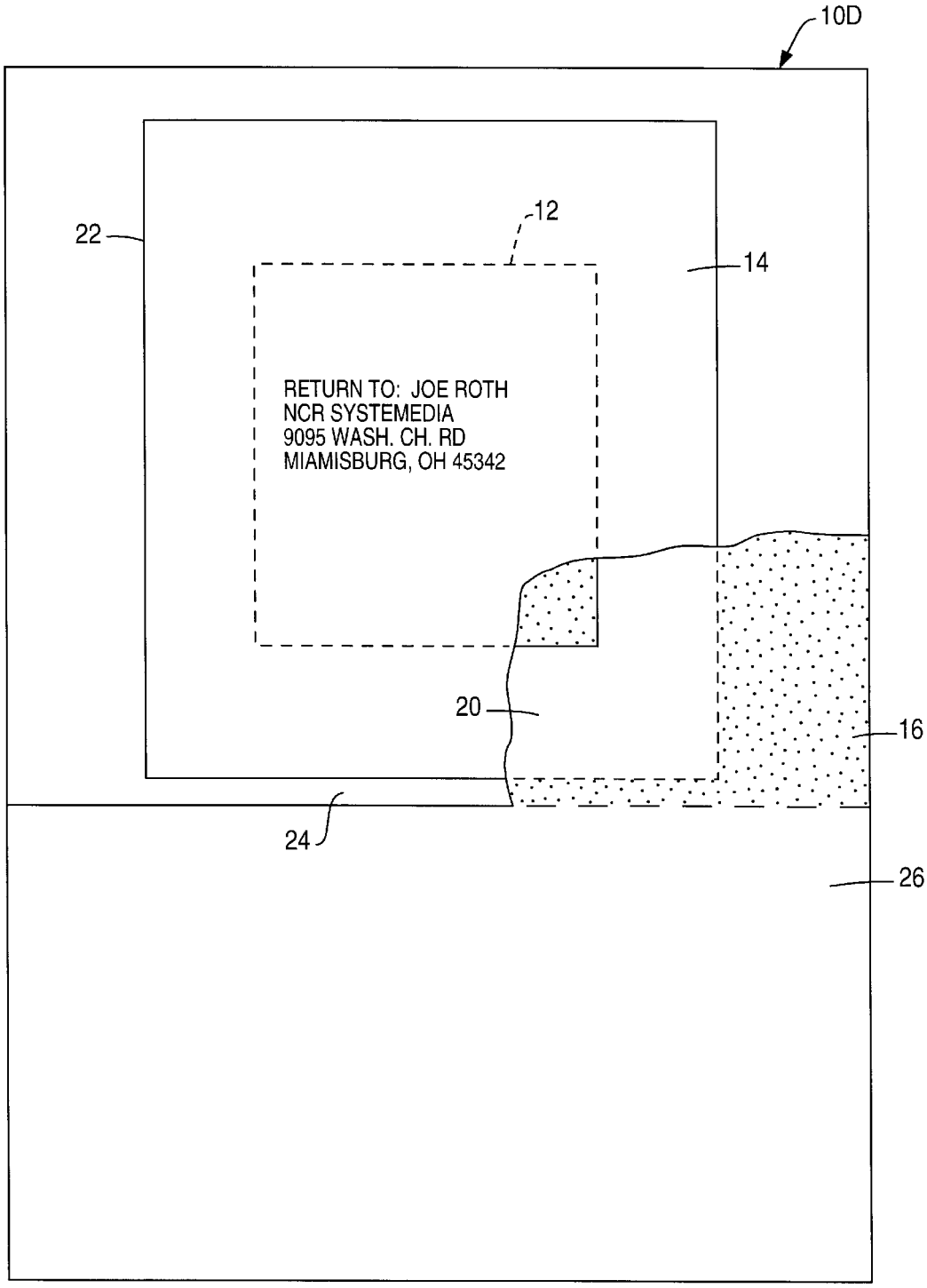
FIG. 9 is a back view of the duplex label laminate illustrated in FIG. 8.
Figure 10:
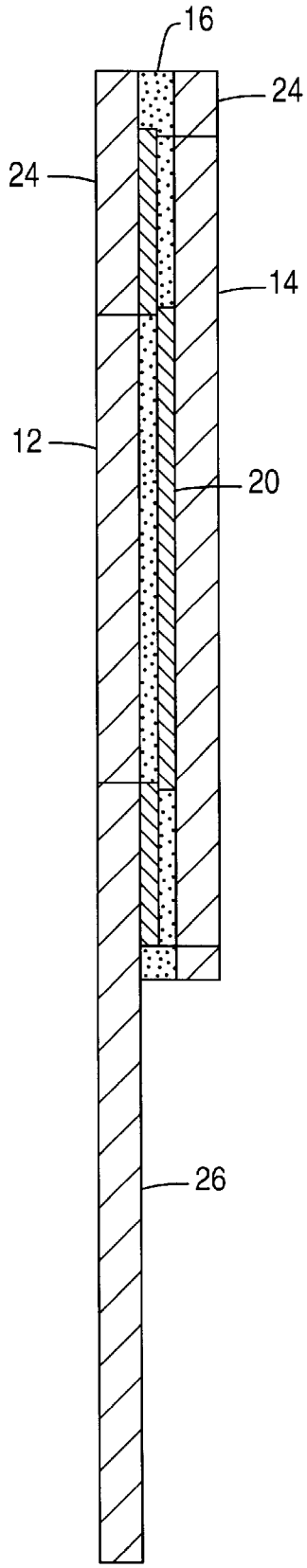
FIG. 10 is a sectional view of the duplex label laminate illustrated in FIG. 8 and taken along line 10—10.

Illustrated in FIGS. 8–10 is yet another embodiment of the duplex label laminate, designated 10D, which is similar to the FIG. 7 embodiment. In this embodiment a single pair of first and second labels 12,14 are again nested back-to-back, with the first label 12 being disposed in one full size face sheet also including the integral form 26, and the second label 14 being disposed on another part-size face sheet on the back thereof. The two face sheets and labels thereon are preferably opaque, such as being formed of ordinary paper so that both labels may be pre-printed or printed on demand with corresponding send and return addresses for use in sending a mailer.

Preferably the smaller first label 12 is printed with the send-to address, peeled away from the opposite face sheet and second label 14, and then attached to a package or mailer such as that shown in FIG. 7. The remaining second label 14 and form 26 may then be packaged inside the package as a shipping list or invoice, and the package suitably delivered to the intended recipient.

Upon receipt of the package, the recipient may then use the second label 14 to return the package to the sender if desired. This is accomplished by peeling away the second label 14 from the remaining rim 24 and form 26 of the laminate, and attaching the second label to the same package over the original first label, or attaching the second label to another container if desired. The second label may be pre-printed with the original sender's address for convenience, or may be blank, with the receiver then printing any desired forwarding address thereon.

The two labels 12,14 have their own pressure sensitive adhesive on the backs thereof, and thus are easily and permanently affixed to the corresponding package position when used. The two labels are opaque, and thusly the second label may be used to hide the printing of the first label when positioned thereof.

And, the two labels enjoy the same advantages as the previous embodiments including the elimination of the conventional release liner and corresponding waste therefrom. The perimeter rims 24 of the two labels 12,14 may be permanently joined or locked together to strengthen the laminate and prevent liberation thereof when the labels are removed.

Figure 11:
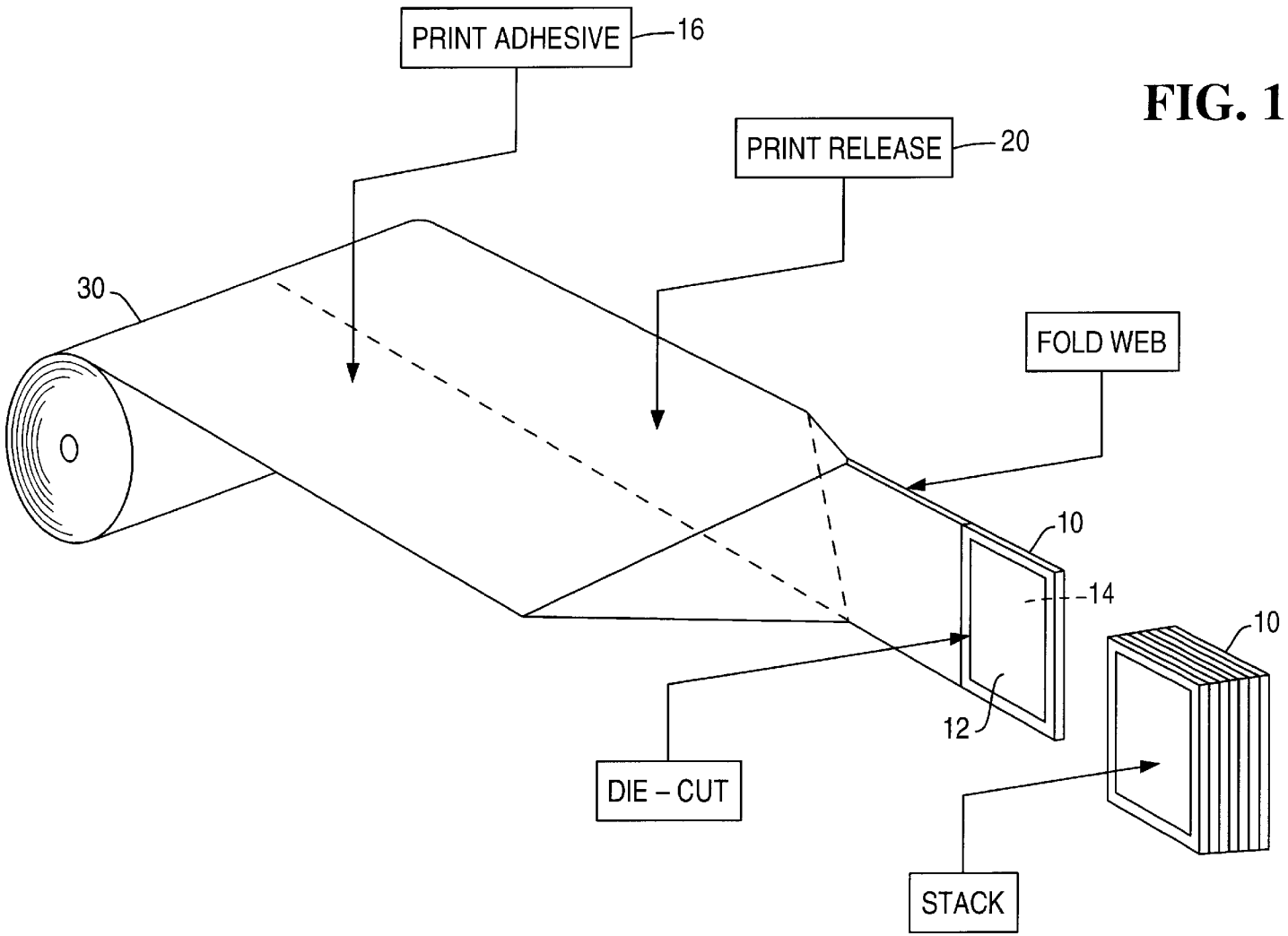
FIG. 11 is a schematic view of a method of manufacturing the duplex label laminates in accordance with an exemplary embodiment.

FIG. 11 illustrates schematically an exemplary method of making the duplex label laminate in the various configurations illustrated in FIGS. 1–10 in accordance with an exemplary embodiment. A common web 30 of face sheet material is mounted in a printing press which may have any conventional configuration, such as a flexographic printing press. The desired patterns of adhesive 16 may then be printed over the back side of the web as it travels through the press.

Similarly, a liquid silicone release agent 20 may also be printed atop the back side of the web in the desired pattern to form the corresponding release blanks of the desired labels. The printed silicone is preferably cured atop the web by ultraviolet (UV) light in the preferred embodiment.

A conventional plow folder is then used for folding the web 30 in half along its running axis to laminate together the two portions thereof at their corresponding adhesive patches in register or alignment with the corresponding release blanks.

The so folded and laminated web is then suitably cut to form the individual duplex label laminates in any of the forms disclosed above, with the individual labels being defined by suitable die-cut perimeters thereof. The single duplex labels illustrated in FIGS. 1–4 may be formed individually, or in a preferred embodiment are formed in larger groups from the correspondingly large web 30. Similarly, the multiple-label duplex label laminates illustrated in FIGS. 5 and 6 may be formed in singular or multiple sheets according to the size of the web 30 used. And, the integrated duplex label laminate and form sheet illustrated in FIGS. 7–10 may be correspondingly formed by folding only a portion of the web to form the duplex label laminate portion thereof.

Figure 12:
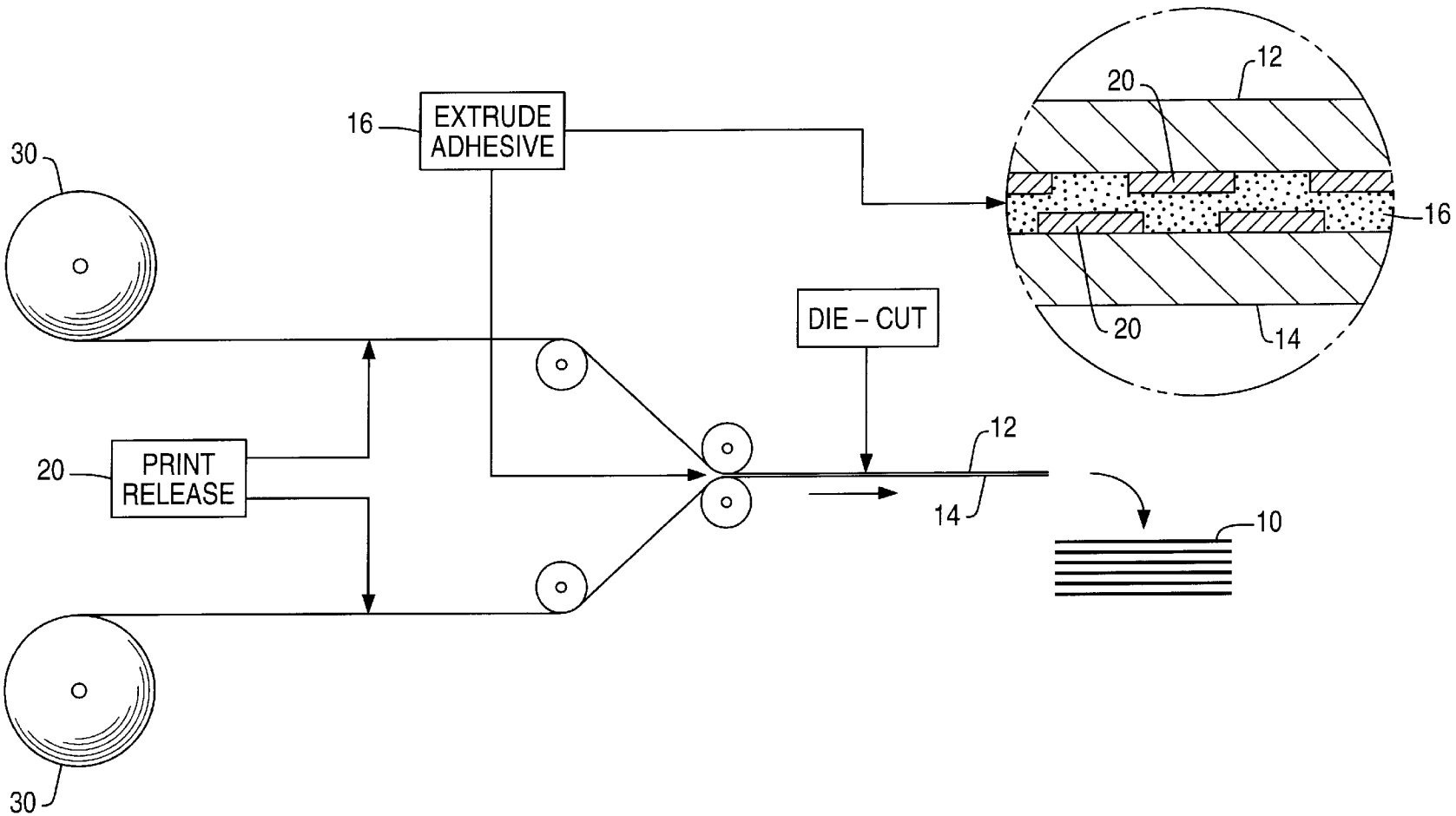
FIG. 12 is a schematic view of a method of manufacturing the duplex label laminates in accordance with an alternate embodiment.

FIG. 12 illustrates another embodiment of making the duplex label laminates which uses two webs 30 of face sheet material mounted in a suitable printing press, with the silicone release agent 20 being printed on the back sides thereof in the desired patterns corresponding with any of the laminate configurations disclosed above. Instead of printing the adhesive 16 in the desired pattern, the adhesive may be simply extruded between the entire surfaces of the two webs as they are laminated together using suitable rollers.

In this embodiment, the thin layer of adhesive 16 extruded between the two face sheet laminates will permanently bond to the exposed portions of the face sheets which do not have the release agent printed thereupon. Thin adhesive ligaments will then remain between the opposite release blanks of the two laminates, but will form weak bonds with those release blanks. The weak bonds are readily broken as the individual labels are removed from the duplex label laminate.

The extruded laminate illustrated in FIG. 12 may be suitably cut into the desired configurations of the duplex label laminates either in single or multiple sheets. And, the perimeters of the individual labels are preferably die-cut to the desired configuration.

The duplex label laminate disclosed above in various embodiments enjoys the benefits and variety of ordinary adhesive labels without the need for an independent and separate silicone release liner which would be discarded as waste. In all embodiments disclosed above, adhesive is permanently bonded to the back of each of the duplex labels in the various adhesive patterns. The release blanks devoid of adhesive on the opposite label provide self-lining to its opposite label. Each label thusly includes adhesive for later mounting the label to any desired surface, while the opposite face sheet includes the release blank for initially mounting the labels and permitting their ready removal therefrom Since the adhesive bonds formed at the release blanks are weak and merely temporary, it is desirable to incorporate permanent bonds at some or all portions of the surrounding rims of the laminates.

The ability to print the release agent or adhesive or both on the corresponding face sheets during the manufacturing process permits a great variety in the configuration of the opposing duplex labels of the resulting laminates. Each duplex label has at least some, if not full, adhesive coverage on its back side and is mounted to the back side of a face sheet having the corresponding pattern of release blank permitting its ready removal therefrom.

Accordingly, most if not all of both face sheets in the duplex label laminate may be used for creating labels with substantially little waste remaining after the individual labels are removed therefrom for correspondingly reducing overall cost of the labels. The improved strength of the two face-sheet laminate provides improved handling and performance in conventional printers, such as laser printers.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

1. A duplex label laminate comprising first and second labels laminated together by complementary patterns of adhesive patches fixedly bonded thereto, said adhesive patches cooperating with opposite blanks including release for forming a removable bond with said adhesive patches in a continuous bond plane therebetween, and said release blanks being larger than respective ones of said adhesive patches.

2. A laminate according to claim 1 wherein each of said labels includes a die-cut perimeter surrounded by a rim, and said rims of said first and second labels are disposed opposited to each other and fixedly bonded together by a portion of said adhesive patches on said first label and a portion of said adhesive patches on said second label.

3. A laminate according to claim 2 wherein said complementary adhesive patterns are nested.

4. A laminate according to claim 2 wherein said complementary adhesive patterns comprise alternating stripes of said adhesive.

5. A laminate according to claim 2 wherein said adhesive patches and release blanks alternate laterally across said perimeters of said labels.

6. A laminate according to claim 5 wherein said adhesive patches and release blanks alternate in stripes inside said label perimeters, and said label perimeters are offset from each other atop corresponding ones of said adhesive stripes.

7. A laminate according to claim 5 wherein said adhesive patches and release blanks alternate in checkerboard patterns inside said label perimeter.

8. A laminate according to claim 5 wherein said first and second labels have substantially equal size.

9. A laminate according to claim 2 wherein each of said labels includes a perimeter, and said adhesive patch for said first label covers said first label within said perimeter thereof, said adhesive patch for said second label borders said perimeter thereof, and said release blank is disposed centrally inside said second label opposite to said adhesive patch of said first label.

10. A laminate according to claim 9 wherein said first label is smaller than said second label, and sized to fit within said central release blank of said second label.

11. A laminate according to claim 10 wherein said first label is opaque, and said second label is transparent.

12. A laminate according to claim 1 further comprising first and second face sheets each including a respective plurality of said first and second labels defined by respective die-cuts.

13. A laminate according to claim 12 wherein each of said face sheets includes corresponding perimeter rims fixedly bonded together.

14. A duplex label laminate comprising first and second labels laminated together by complementary checkerboard patterns of adhesive patches fixedly bonded thereto, said adhesive patches cooperating with opposite blanks in said labels devoid of said adhesive, and said blanks including release for forming a removable bond with said adhesive patches in a continuous plane therebetween.

15. A duplex label laminate comprising first and second labels laminated together by patches of adhesive alternating oppositely therebetween and cooperating with opposite release zones devoid of said adhesive in a continuous bond plane therebetween; said labels having die-cut perimeters surrounded by rims permanently bonded together; and each of said labels being removable from the other at said release zones and removable from said rims at said die-cut perimeters.

16. A laminate according to claim 15 wherein said release zones include corresponding release coatings on said first and second labels laterally adjoining said adhesive patches on one label and being larger than corresponding adhesive patches on the other label.

17. A duplex label laminate comprising:

a first face sheet including a plurality of first labels having die-cut perimeters, with each of said first labels being covered by an adhesive patch within said perimeter thereof and surrounded by a release matrix;

a second face sheet including a plurality of second labels having die-cut perimeters, with each of said second labels having an adhesive border surrounding a central release zone; and each of said first labels being smaller than a corresponding second label and laminated to said central release zone thereof for nesting said first labels with said second labels and permitting individual removal of said first and second labels from each other.

18. A method of making said laminate according to claim 1 comprising:

printing said adhesive and release atop a web to form said patterns and blanks of said labels;

folding said web to laminate together said adhesive patches in register with said release blanks; and cutting said folded web to define said duplex label laminate with opposite first and second labels.

19. A method of making said laminate according to claim 1 comprising:

printing said release atop two webs to form said blanks of said labels;

extruding said adhesive between said two webs to cover said webs between said blanks to from said adhesive patterns therebetween;

laminating together said two webs with said adhesive patterns in register with said release blanks; and cutting said laminated webs to define said duplex label laminate with opposite first and second labels.

20. A method of using said laminate according to claim 10 comprising:

printing indicia on said first label;

removing said first label from said second label;

bonding said first label to a surface;

removing said second label from said laminate; and bonding said second label over said first label atop said surface.

* * * * *

UNITED STATES PATENT AND TRADEMARK OFFICE

CERTIFICATE OF CORRECTION

PATENT NO. : 6,596,359 B2
DATED : July 22, 2003
INVENTOR(S) : Roth, J.D. and Finster, W.

It is certified that error appears in the above-identified patent and that said Letters Patent is hereby corrected as shown below:

Column 8,
Line 2, after “blanks” insert -- devoid of said adhesive, said blanks --.
Line 55, after “continuous” insert -- bond --.

Column 10,
Line 6, delete “from” and insert -- form --.

Signed and Sealed this

Twenty-eighth Day of September, 2004

JON W. DUDAS
*Director of the United States Patent and Trademark Office*